US005476157A

United States Patent [19]

Todaro

[11] Patent Number: 5,476,157

[45] Date of Patent: Dec. 19, 1995

[54] ELEVATOR CONTROL SYSTEM WITH ELEVATOR HOISTWAY OPERATION MONITORING SYSTEM AND METHOD

[76] Inventor: Sam S. Todaro, 6453 N. Knox, Lincolnwood, Ill. 60646

[21] Appl. No.: 254,045

[22] Filed: Jun. 3, 1994

[51] Int. Cl.[6] ..... B66B 1/28; B66B 5/02; B66B 13/00

[52] U.S. Cl. ..... 187/280; 187/316; 187/393

[58] Field of Search ..... 187/390, 391, 187/393, 317, 316, 249, 280

[56] References Cited

U.S. PATENT DOCUMENTS

| | | | |
|---|---|---|---|
| 1,973,920 | 9/1934 | Wilson | 187/16 |
| 3,461,422 | 8/1969 | Hansen | 340/21 |
| 4,108,281 | 8/1978 | Glaser | 187/29 R |
| 4,367,810 | 1/1983 | Doane et al. | 187/29 R |
| 4,898,263 | 2/1990 | Manske et al. | 187/133 |
| 5,025,895 | 6/1991 | Leone et al. | 187/105 |

*Primary Examiner*—Peter S. Wong
*Assistant Examiner*—Robert Nappi
*Attorney, Agent, or Firm*—Potthast & Ring

[57] ABSTRACT

An elevator control system (40) for automatically controlling the operation of an elevator car (22A) having a car door (24A) in which the elevator moves between different floor levels of an elevator shaft (30A) in which each floor level has associated hoistway doors (26A, 26C) for providing access to the elevator car (22A) in the shaft (30A) and an elevator hoistway operation monitoring system (34) with individual floor monitoring switches (32) for determining the floor level location of the elevator car (22A), individual hoistway door monitoring sensors (38) for sensing the opening of a hoistway door (26A) relays (56, 58, 52) and contact (50) coupled with an elevator safety circuit (42) for automatically preventing the elevator car (22A) from moving if a hoistway door (26A) is opened at a floor level other than the floor level at which the elevator car (22A) is located and for prohibiting the car (22A) from moving in response to the closing of the opened hoistway door (26A).

21 Claims, 2 Drawing Sheets

ELEVATOR CONTROL SYSTEM WITH ELEVATOR HOISTWAY OPERATION MONITORING SYSTEM AND METHOD

BACKGROUND OF THE INVENTION

1. Field of the Invention

This invention relates generally to the field of elevator control systems and more particularly to such control systems employing elevator security and safety devices.

2. Description of the Related Art Including Information Disclosed Under 37 C.F.R. §1.97–1.99

In known elevator systems, an elevator car arrives at a floor and the hoistway doors and the elevator car doors at that floor open together to provide access in and out of the car. Subsequently, the elevator car doors close and the car automatically proceeds to its next destination. If a hoistway door on any floor is maliciously or accidentally opened when the elevator car is not present at that floor, the elevator car in the shaft in which the hoisting door was forced open is brought to a halt in known elevator systems. Disadvantageously, this allows a criminal, juvenile or any other unauthorized personnel to open a set of hoistway doors at the floor above the car, resulting in the car stopping by such opening thereby enabling such unauthorized individuals to gain access to the top of the elevator car. Once the opened spring loaded hoistway doors are released by the unauthorized person, they automatically close and the car in the shaft resumes operation. This allows the individual riding on top of the car to gain access to the inside of the car through the top hatch. Moveover, the individual can ride the elevator car from the outside and jump to adjacent cars moving within the elevator bank. The riding of cars from the outside is informally referred to as "elevator surfing" which is an extremely dangerous and problematic situation occurring in residential urban high rise buildings and college dormitories.

Attempts have been made to provide safety and security devices in elevator systems. In U.S. Pat. No. 5,025,895 to Leone et al. an elevator control system utilizes a proximity detection circuit to discover the presence of a person or an object on the shaft-ride roof of an elevator cab. The proximity detection circuit uses an optical beam source for generating a detection beam across a predetermined area on the elevator roof. In response to the optical beam detecting an unauthorized entry onto an elevator roof, an audible siren is actuated and the operation of the car is discontinued. Unfortunately, unauthorized individuals are able to avoid detection by merely stepping away from the path of the optical beam. Furthermore, the Leone et al. system requires that the car be equipped with costly photoelectric cells and the associated complex circuitry. Moreover, once the individual exits the path of the optical beam, thereby reinstating the beam, the elevator car continues to move from floor to floor at its normal operation. Thus, the unauthorized person is able to ride or "surf" on the top of the moving elevator car once the individual leaves the path of the optical beam. The system of Leone et al. merely detects intrusions in the path of an optical beam and does not address the dangers associated with "elevator surfing."

In U.S. Pat. No. 4,108,281 to Glaser an elevator door protection system prevents a car from moving from a floor when certain switch contacts operated or shunted by unauthorized persons or by a short circuit, an alarm sounds if a cab or hoistway door is opened improperly. The elevator door protection system functions if a first set of switches is operated prior to a second set of designated switches. The operating or shunting of the switches in their procedural order indicates that the switches have been tampered with and a control circuit prevents movement of the car. Disadvantageously, movement of the elevator car is prevented only if the car door switches have been manipulated. Thus, if a hoistway door is opened and subsequently closed on a floor other than the floor at which the car is located without any tampering to the switches, the car will resume its operation. The system of Glaser merely monitors the elevator car doors and does not monitor the opening and closing of hoistway doors located at different floors of a building. Therefore, unauthorized individuals can gain access to the elevator car roof and "ride" on top of the car as it moves through the hoistway or elevator shaft area.

In U.S. Pat. No. 4,367,810 to Doane et al. an elevator control system monitors cab and hoistway doors to arrest motion of the cab if any of the cab or hoistway doors are not closed. The control system employs a microprocessor based cab controller mounted directly on the cab to monitor and analyze the functions operating within the cab. The controller further determines if the car is at a proper distance from a landing or if a car is travelling at an improper speed with respect to a landing. The cab controller communicates with remotely controlled circuits to disable the car motion and a car controller in a machine room inhibits door motion. However, the cab controller of the Doane et al. patent does not function to arrest car motion if unauthorized access to the top of the car is accomplished.

SUMMARY OF THE INVENTION

It is therefore a principal object of the present invention to provide an elevator control system with an elevator hoistway operation monitoring system in which the disadvantages of known elevator control systems noted above are overcome by providing means for automatically preventing an elevator car from moving in an elevator bank of elevator cars if a hoistway door is opened at a floor level other than the location of the elevator car and for prohibiting the car from moving upon the closing of the opened hoistway door.

The object is achieved by providing an elevator control system for automatically controlling the operation of an elevator car having a car door in which the elevator car moves between different ones of a plurality of floor levels through an elevator shaft and in which said floor levels each have a hoistway door providing access to the elevator car in the shaft and an elevator hoistway operation monitoring system with means for automatically determining which ones of a plurality of floor levels the elevator car is located, means for sensing movement of opening of at least one of the hoistway doors, means for automatically preventing the elevator car from moving if the at least one hoistway door is opened at a floor level other than the floor level at which the elevator car is located, and means for prohibiting the elevator car from moving in response to a closing of the at least one hoistway door at the floor level other than the floor level at which the elevator car is located.

The object is also achieved by providing an elevator control system for automatically controlling the operation of an elevator car having a car door in which the elevator car moves between different ones of a plurality of floor levels in which an associated hoistway door is located on each of the plurality of floor levels to provide access to the elevator car at each floor and in which at least one other elevator car is located in an elevator bank with the elevator car in which the at least one other elevator car in the bank moves between different ones of another plurality of floor levels in which an associated another hoistway door is located on each of said other plurality of floor levels to provide access to the at least one other elevator car with an elevator hoistway operation monitoring system having means for determining the floor level of the elevator of the elevator car in the bank, means for sensing movement of an opening of at least one hoistway door associated with the elevator car at a floor level other then the floor level at which the elevator car is located, and means responsive to the sensing movement means for automatically preventing the at least one hoistway door associated with the elevator car is opened at a floor level other than the floor level at which the elevator car is located.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENT

Figure 1:
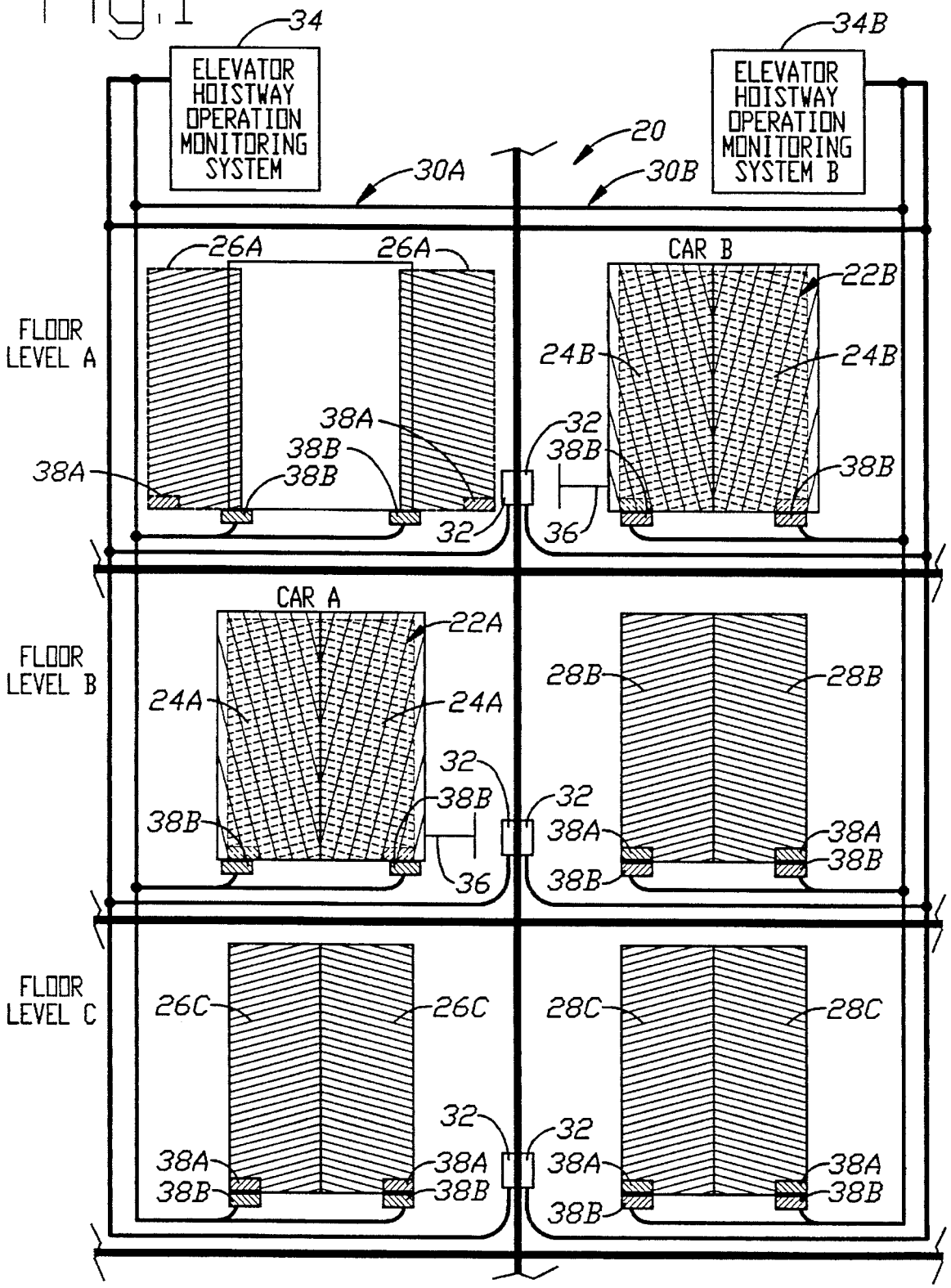
FIG. 1 is a pictorial representation of a plurality of elevator cars located at various floor level locations in an elevator bank as interrelated with the elevator hoistway operation monitoring system of the present invention.

Referring to FIG. 1, a pictorial representation of an elevator bank 20 is shown having a plurality of elevator cars 22A and 22B which move between a plurality of floor levels. The elevator cars 22A and 22B each have an associated elevator door 24A and 24B for entrance to and egress from at the elevator cars. At each of the floor levels associated hoistway doors 26A, 26C, 28B and 28C are located for entrance into the segmented elevator shaft regions 30A and 30B which comprise the elevator bank 20. As seen in FIG. 1, elevator car 22A rides through segmented elevator shaft region 30A associated with hoistway doors 26A at floor level A and hoistway doors 26C at floor level C in the elevator bank 20. Elevator car 22B rides through segmented elevator shaft region 30B associated with hoistway doors 28B at floor level B and hoistway doors 28C at floor level C of the elevator bank 20. Floor level location B of segmented elevator shaft region 30A and floor level location A of segmented elevator shaft region 30B also have associated hoistway doors which are not shown in order to better illustrate the positions of elevator car 22A and elevator car 22B.

A plurality of floor monitoring switches 32 are located at each floor level location and at each segmented elevator shaft region 30A and 30B within the elevator bank 20. The floor monitoring switches 32 when actuated provide a signal to an elevator hoistway operation monitoring system 34. Preferably, a cam 36 having a predetermined length is connected to each elevator car 22A, 22B and moves as the car travels between the various floor level locations designated by the plurality of hoistway doors. The floor monitor switches 32 are preferably magnetic switches which sense the floor location of the elevator car 22A, 22B. A floor monitor switch 32 is triggered in response to the cam 36 connected to the car 22A being positioned within a predetermined distance, such as two feet above or below the floor monitor switch. Preferably the switch 32 is open until the cam 36 of the car reaches a floor level location thereby closing the switch 32 associated with the particular floor level. The actuation or closing of a floor monitor switch 32 associated with a particular floor level provides a signal to the elevator hoistway operation monitoring system 34 indicating that the car 22A is positioned at a floor level location associated with the actuated floor monitor switch. Alternative means such as employment of photoelectric sensors, dump switches, proximity switches, electric eyes and the like, may be used for automatically determining the floor level location of an elevator car relative to the opening of the hoistway doors.

A pair of magnetic reed switches or individual hoistway door monitoring sensors 38A, 38B are also used to trigger the elevator hoistway operation monitoring system 34. The hoistway doors 26C, when closed maintain a closed contact thereby providing current to the elevator hoistway monitoring system 34. However, when the hoistway doors are opened such as doors 26A of FIG. 1, the contact between the individual hoistway door monitoring sensors 38A and 38B becomes opened thereby removing the current to monitoring system 34. One magnetic reed switch 38B is preferably embedded into the elevator track for each hoistway door 26A, 26C, 28B, 28C in the bank 20 and at each floor level location. The magnetic reed switch 38B is positioned into the elevator floor track wherein the hoistway doors slide at a height equal or below the track to prevent individuals from kicking or stumbling over the reed switches. Another magnetic reed switch 38A is preferably mounted to a bottom location of the hoistway door 26A, 26C, 28B, 28C. If the magnetic reed switches 38A and 38B are positioned in an overlying relation, the hoistway doors 26C, 28B and 28C as seen in FIG. 1 for a particular floor location are sensed as being closed since the contact between the switches 38A, 38B is closed.

If the hoistway doors are opened, as seen with hoistway doors 26A of FIG. 1, the magnetic reed switch 38A connected with hoistway doors 26A will move away from an overlaying relation with the stationary reed switch 38B, thereby opening the electrical contact and providing an indication that an opening of the hoistway doors for the particular floor level location at floor level A. The separation of the reed switches 38A, 38B senses an opening of the hoistway doors thereby removing current on a line and providing a signal of such opening for a particular floor location to the elevator hoistway operation monitoring system 34 coupled therewith. As seen in FIG. 1, each elevator car in the bank 20 has an associated elevator hoistway operation monitoring system. Elevator car 22A which moves through segmented elevator shaft region 30A is associated with monitoring system 34 and elevator car 22B which moves through segmented shaft region 30B is associated with another elevator hoistway operation monitoring system 34B.

In accordance with the present invention, in response to the sensing of an opening of a hoistway door at a floor level other than the floor level determined by the floor monitoring switches 32 to be at the location of the elevator car, the car thereby is automatically prevented from moving through the elevator bank 20. Additionally, the elevator hoistway operation monitoring system 34 continues to prevent and prohibits the elevator cars from moving through the elevator shaft region of the elevator bank 20 even if the opened hoistway doors at a floor level other than the level of the location of the car are subsequently closed. For example, as seen in FIG. 1, the opening of hoistway doors 26A at floor level A automatically prevents elevator car 22A located at floor level B from moving within the bank 20. Additionally, in response to the subsequent closing of the hoistway doors 26A the elevator hoistway operation monitoring system 34 keeps the elevator car 22A stationary thereby prohibiting the car 22A from moving within the elevator shaft in the bank. In an emergency condition the elevator hoistway door monitoring system 34 continues to be energized upon a subsequent closing of hoistway doors through self-holding contact 58A as described in detail with reference to FIG. 2. Thus, individuals are prevented from "riding" or "elevator surfing" on the outside of an elevator car by gaining access through the opening and closing hoistway doors at locations adjacent to the elevator car.

In a further aspect of the present invention, the elevator hoistway operation monitoring system 34 prevents other elevator cars in the bank 20, such as car 22B, from moving if a hoistway door 26A associated with the shaft regions segment 30A for elevator car 22A is opened at a floor level other than the floor level location of its associated elevator car 22A. Accordingly, the other car 22B at the same floor level location (i.e., floor level A of FIG. 1) as the hoistway doors 26A which are opened and subsequently closed, is also prevented from moving since the system 34 detects an improper hoistway door 26A opening as a result of elevator car 22B being at floor level location B which differs from the floor level location A of the hoistway door opening. The elevator hoistway operation monitoring system 34 continues to maintain and prohibit the other elevator car 22B from moving within the bank 20 even upon a subsequent closing of the hoistway doors 26A. All the elevator cars 22A, 22B in the bank 20 are prohibited from moving upon any opening and subsequent closing of a hoistway door which is at a location which differs from the location of the elevator car associated with the hoistway doors.

Figure 2:
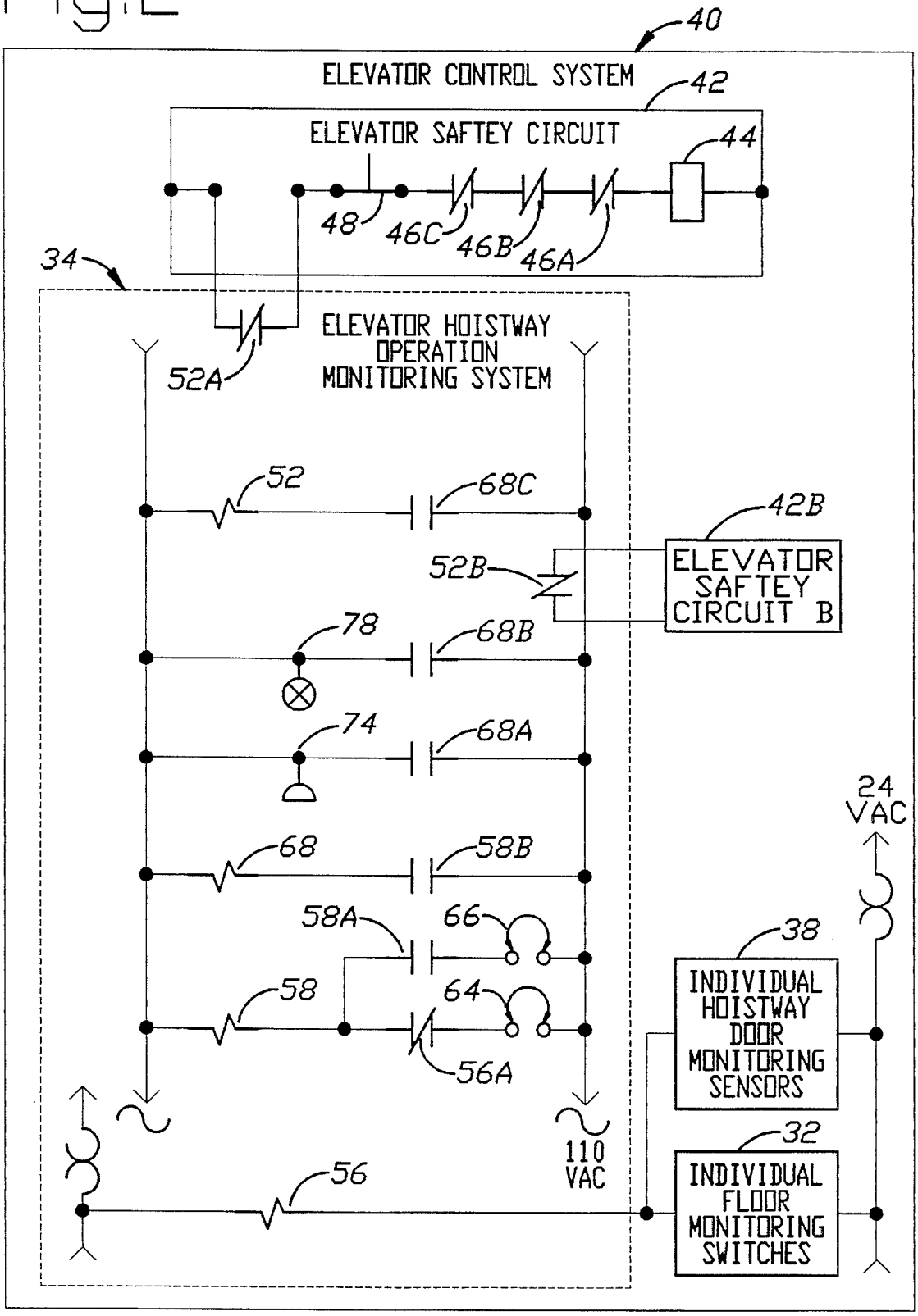
FIG. 2 is a schematic diagram of the elevator control system of the present invention with the elevator hoistway operation monitoring system operating in conjunction with elevator safety circuits.

Referring now to FIG. 2, an elevator control system 40 of the present invention is shown having an elevator safety circuit 42 coupled with the elevator hoistway operation monitoring system 34. The elevator safety circuit 42 is often also referred to as the potential switch, C-Switch or safety by those skilled in the field of elevator control systems. The elevator safety circuit 42 has an elevator safety circuit relay 44 for providing electrical power to an elevator car 22A associated with and coupled with the elevator safety circuit. Elevator safety circuit has a plurality of contacts 46A, 46B, 46C. A stop switch 48 coupled with the safety circuit relay 44 is provided in the elevator safety circuit 42 for stopping the movement of an elevator car 22A, 22B through the elevator shaft in the bank 20 of cars. Coupled with the stop switch 48 of the elevator safety circuit 42 is contact 52A of the elevator hoistway operation monitoring system 34. Relay 52 which activates contact 52A upon an emergency condition is placed in series with contact 52B. Contact 52B is also coupled with relay 52 and with another elevator safety circuit 42B which is associated with and controls the operation of each of the another elevator car such as car 22B in the bank 20 FIG. 1. For instance, the activation of relay 52 in an emergency condition opens normally closed contact 52B which is connected to other elevator safety circuit 42B which, in turn, prevents elevator car 22B in the bank associated with contacts 52B from moving. Employment of additional contacts coupled with relay 52 and other elevator safety circuits may alternatively be used to prevent and prohibit all other elevator cars from moving in an elevator bank. Preferably each elevator safety circuit controlling movement of each elevator car in a bank also has an associated elevator hoistway operation monitoring system to stop all elevator cars from moving in the bank upon the detection of an emergency condition.

The individual hoistway door monitoring sensor 38 determines the opening of a hoistway door 26A, FIG. 1, and the individual floor monitoring switches 32 determine the floor level location for an elevator car 22A in the bank 20. The individual hoistway door monitoring sensors 38, of FIG. 2, are representative of the pair of magnetic reed switches 38A, 38B at each floor level location of FIG. 1. If hoistway door 26A is determined to be opened when the elevator car 22A associated with the hoistway door is at a floor level, such as floor level B of FIG. 1, which differs from the floor level (i.e., level A) of the opened hoistway door, then an emergency condition results and the elevator hoistway operation monitoring system 34 is activated. Under normal conditions, relay 56 is energized, however, when the monitoring system 34 is activated upon a determination of an emergency condition, relay 56 is deactivated. Contact 56A which is opened when relay 56 is energized under normal operating conditions becomes closed thereby energizing relay 58 during an emergency condition.

An emergency condition occurs if elevator hoistway doors 26A, FIG. 1, are opened at a floor location which differs from the floor location of the elevator car 22A associated with the opened hoistway doors. Under normal operating conditions the individual hoistway door monitoring door sensors or magnetic reed switches 38, FIG. 2, are closed thereby providing power to relay 56 if the hoistway doors associated with the hoistway door monitoring sensors are closed. The individual floor monitoring switches 32 are opened under normal conditions, if an elevator car is not located at a particular floor level. However, if an elevator car 22A, FIG. 1, arrives at a particular floor level, then the cam 36 activates the floor monitoring switch 32 for that particular floor level location thereby closing the associated individual floor monitoring switch 32. Therefore, if an elevator car arrives at a particular floor level location and the hoistway doors are opened at that floor level location to gain access to the car, the individual hoistway door monitoring switches 38 will open due to the opening of the hoistway doors at the floor level location. However, power is maintained at relay 56 since the individual floor monitoring switch 32 closes upon arrival of the elevator car at the floor level location.

Conversely, in an emergency condition in which an elevator car 22A, FIG. 1, is at a floor level location which differs from the location at which hoistway doors 26A are opened, the normally energized relay 56, FIG. 2, loses power and becomes de-energized which, in turn, closes contact 56A and activates the elevator hoistway operation monitoring system 34 associated with the elevator car 22A. In an emergency condition since the hoistway doors are opened, the individual hoistway door monitoring sensors 38 open, thereby providing no current to relay 56. Additionally, since the elevator car 22A, FIG. 1, is not at the location in which the hoistway doors 26A are opened, the individual floor monitoring switch 32 associated with the floor level location of the opened hoistway doors continues to be open, thereby also providing no current to relay 56. The normally open floor monitoring switch 32 and the opened contact associated with one individual hoistway door monitoring sensor 38 resulting from movement at hoistway doors creates an open circuit which in turn de-energizes the normally energized relay 56. In response to the deactivation of relay 56, contact 56A which is open when relay 56 is energized, now becomes closed thereby providing power to relay 58.

The deactivation of relay 56 immediately energizes relay 58 which, in turn, energizes relay 68 and relay 52. Relay 58 picks or energizes through the closing of contact 56A and relay 58 continues to stay picked through the employment of self-holding contact 58A. The energization of relay 58 closes self-holding contact 58A and contact 58B. Relay 68 picks through normally open contact 58B and relay 68 continues to stay picked as long as relay 58 stays energized. The energizing of relay 68 closes contact 68A to activate an audible alarm bell 74 and contact 68B is closed to activate a visible light alarm 78, preferably a strobe light to signal the initiation of an emergency condition. Relay 68 also closes contact 68C which energizes relay 52.

The activation of relay 58 energizes relay 52 which opens contact 52A thereby removing power to the elevator safety circuit 42 which in turn prevents the associated elevator car 22A, FIG. 1, from moving. The opening of contact 52A removes power to elevator safety circuit relay 44 thereby preventing movement of the associated elevator car. If the opened hoistway doors 26A are closed, relay 52 continues to be energized through self-holding contact 58A energizing relay 58 and the elevator car is prohibited from moving through the elevator shaft. Even upon a subsequent closing of opened hoistway doors in an emergency condition, the energization of monitoring system 34 is maintained through self-holding contact 58A thereby prohibiting all elevator cars from moving in the bank. Relay 52 also opens contact 52B which is coupled with another associated individual elevator safety circuit 42B corresponding to another elevator car in the elevator bank. For example, contact 52B coupled with another elevator safety circuit 42B employed to power the movement of another elevator car 22B, of FIG. 1, opens upon the energization of relay 52, FIG. 2, thereby removing the power to the other safety circuit 42B for the other car 22B, FIG. 1, and preventing car 22B from moving in the bank of cars. Therefore, the activation of relay 52, FIG. 2, removes power to all adjacent elevator cars within an elevator bank. As described in FIG. 1 and 2, the triggering and control of the elevator hoistway operation monitoring system is performed in the preferred embodiment through the employment of relay logic. However, it is noted that other suitable equivalent means may also be used such as the employment of solid state digital electronics, comparitor circuitry, microprocessor based electronics and the like.

The deactivation of relay 58 is performed through employment of an access key switch 64 and a master reset key switch 66. The access key switch 64 disconnects power to relay 58 by opening contact 56A upon actuation of a key therein. The access key switch 64 is primarily used for individual elevator car access in a maintenance condition thereby enabling maintenance personnel to perform repairs on the elevator car by preventing the car from moving in normal operation. The employment of a master reset key (not shown) in the master reset key switch 66 is used to manually de-energize relay 58 which, in turn, deactivates relay 68 and relay 52, thereby enabling the elevator cars prohibited from moving to resume movement through the elevator shaft and return to normal operation. The turning of reset switch 66 opens self-holding contact 58A to de-energize relay 58. Relays 68 and 52 become deactivated which closes contact 52A to enable the elevator car to resume movement and the closing of contact 52B enables movement of all adjacent elevator cars within the bank. The relays 58, 68 and 52 stay activated until the elevator hoistway monitoring system 34 is turned off manually through actuation of the reset switch 66.

While a detailed description of the preferred embodiment of the invention has been given, it should be appreciated that many variations can be made thereto without departing from the scope of the invention as set forth in the appended claims.

I claim:

1. In an elevator control system for automatically controlling the operation of an elevator car having a car door in which said elevator car moves between different ones of a plurality of floor levels through an elevator shaft and in which said floor levels each have a hoistway door providing access to the elevator car in the shaft the improvement being an elevator hoistway operation monitoring system comprising:

means for sensing an opening of at least one of the hoistway doors at one of a plurality of floor levels and sensing a location of the elevator car at one of a plurality of floor levels;

means for automatically preventing the elevator car from moving if the at least one hoistway door is opened at a floor level other than the floor level at which the elevator car is located; and means for prohibiting the elevator car from moving upon a subsequent closing of the at least one hoistway door at the floor level other than the floor level at which the elevator car is located an which the prohibiting means is directly actuated with positioning the at least one hoistway door in an opened position at a floor level other than the floor level at which the elevator car is located.

2. The elevator control system of claim 1 in which the automatic preventing movement means includes means for preventing movement of at least one other elevator car positioned laterally adjacent to the elevator car whereby the other elevator car is in a bank of elevator cars in which the elevator car is located in response to the sensing means sensing the opening of said at least one of the hoistway doors at a floor level other than the floor level at which the elevator car is located.

3. The elevator control system of claim 2 in which the automatically preventing movement means includes means for preventing movement of all elevator cars in said bank.

4. The elevator control system of claim 3 in which the prohibiting means prevents movement of all elevator cars in said bank upon the subsequent closing of the hoistway door at a floor level other than the floor level at which the elevator car is located.

5. The elevator control system of claim 2 in which the prohibiting means prevents the movement of said at least one other elevator car in response to the closing of the hoistway door at the floor level other than the floor level in which the elevator car is located.

6. The elevator control system of claim 2 in which said sensing means includes means for sensing opening of another hoistway door associated with said at least one other elevator car in said bank, and means for preventing movement of the elevator car in response to the sensing of the opening of the other hoistway door in which the other hoistway door is located at a different level than said at least one other elevator car is located.

7. The elevator control system of claim 6 in which the prohibiting means prevents movement of said at least one other elevator car upon a subsequent closing of the other hoistway door located at a different level than said at least one other elevator car is located.

8. The elevator control system of claim 1 including means for deactivating the prohibiting means to resume movement of the elevator car through the elevator shaft.

9. The elevator control system of claim 1 in which said automatically preventing means is coupled with an elevator safety circuit of the elevator control system.

10. The elevator control system of claim 1 including means for activating one of: (a) an audible alarm coupled with the automatically preventing means, (b) a visible light alarm coupled with the automatically preventing means, or (c) both (a) and (b).

11. In an elevator control system for automatically controlling the operation of an elevator car having a car door in which said elevator car moves between different ones of a plurality of floor levels in which an associated hoistway door is located on each of said plurality of floor levels to provide access to the elevator car at each floor and in which at least one other elevator car is located in an elevator bank with said elevator and in which the at least one other elevator car is spaced laterally from the elevator car in the elevator bank and in which said at least one other elevator car in the bank moves between different ones of another plurality of floor levels in which an associated another elevator hoistway door is located on each of said other plurality of floor levels to provide access to the at least one other elevator car, the improvement being an elevator hoistway operation monitoring system comprising:

means for determining the floor level of the elevator car in the bank;

means for sensing an opening of at least one hoistway door associated with the elevator car at a floor level other than the floor level at which the elevator car is located; and means responsive to said sensing means for automatically preventing said at least one other elevator car in the bank from moving if said at least one hoistway door associated with the elevator car is opened at a floor level other than the floor level at which the elevator car is located.

12. The elevator control system of claim 11 including means for preventing movement of the elevator car in response to the sensing movement means.

13. The elevator control system of claim 12 including means for prohibiting said elevator car from moving upon a subsequent closing of said at least one associated hoistway door at the floor level other than the floor level at which the elevator car is located.

14. The elevator control system of claim 13 including means for deactivating the prohibiting means to resume movement of said elevator car.

15. The elevator control system of claim 12 including means for prohibiting movement of the at least one other elevator car upon subsequent closing of the hoistway door at the floor level other than the floor level at which the elevator car is located.

16. The elevator control system of claim 15 including means for deactivating the prohibiting means to resume movement of said at least one other elevator car.

17. The elevator control system of claim 11 including means for sensing movement of opening of at least one other hoistway door associated with the at least one other elevator car;

means for determining the floor level of the at least one other elevator car, and means for automatically preventing movement of the at least one other elevator car in response to opening of the at least one other hoistway door associated with the said at least one other elevator car at the floor level other than the floor level at which the at least one other elevator car is located.

18. The elevator control system of claim 17 including means for prohibiting movement of all elevator cars in said bank upon subsequent closing of said at least one other hoistway door.

19. The elevator control system of claim 18 including means for deactivating the prohibiting means to resume movement of all of the elevator cars in said bank.

20. The elevator control system of claim 11 in which said automatically preventing means is coupled with an elevator safety circuit of the elevator control system.

21. The elevator control system of claim 11 including means for activating one of: (a) an audible alarm coupled with the automatically preventing means, (b) a visible light coupled with the automatically preventing means, or (c) both (a) and (b).

* * * * *

UNITED STATES PATENT AND TRADEMARK OFFICE

CERTIFICATE OF CORRECTION

PATENT NO. : 5,476,157

DATED : December 19, 1995

INVENTOR(S) : Sam S. Todaro

It is certified that error appears in the above-identified patent and that said Letters Patent is hereby corrected as shown below:

Col. 8, line 25, change "an" to - in -.

Signed and Sealed this

Eighth Day of October, 1996

*Attest:*

*Attesting Officer*

BRUCE LEHMAN

*Commissioner of Patents and Trademarks*